US006992029B1

(12) United States Patent
Chou

(10) Patent No.: US 6,992,029 B1
(45) Date of Patent: Jan. 31, 2006

(54) WOVEN FABRIC OF COMPOSITE MATERIAL

(76) Inventor: Hsiu Chou, P.O. Box 23-90, Chang-Hua City (TW) 500

( * ) Notice: Subject to any disclaimer, the term of this patent is extended or adjusted under 35 U.S.C. 154(b) by 0 days.

(21) Appl. No.: 11/015,248

(22) Filed: Dec. 20, 2004

(51) Int. Cl.
*D03D 15/00* (2006.01)

(52) U.S. Cl. ..... 442/420 C

(58) Field of Classification Search ..... 66/202; 139/383 R, 420 R, 420 C, 425 R; 442/189, 442/210–216
See application file for complete search history.

(56) References Cited

U.S. PATENT DOCUMENTS 2,601,326 A * 6/1952 Rohs et al. ..... 139/426 R
2,958,923 A * 11/1960 Fischer et al. ..... 112/400
3,461,025 A * 8/1969 Coleman et al. ..... 442/3
3,508,589 A * 4/1970 Derick et al. ..... 139/420 R
4,595,627 A * 6/1986 Steinman ..... 442/195
4,926,910 A * 5/1990 Wade ..... 139/425 R
6,080,690 A * 6/2000 Lebby et al. ..... 442/209
6,539,983 B2 * 4/2003 Khokar ..... 139/383 A

* cited by examiner

*Primary Examiner*—Danny Worrell

(57) ABSTRACT

A woven fabric of composite material comprises a longitudinal thread system, a transverse thread system and a multitude of glittery threads. The transverse thread system is woven together with the longitudinal thread system in an interlaced fashion. The glittery threads, which can be colored plastic threads or threads of light-reflecting type, are woven into at least one of the longitudinal thread system and the transverse thread system, whereby a woven fabric thus made will have bright colors and a light reflecting effect. The threads of the longitudinal thread system and the transverse thread system are selected from para-Aramid fibers and glass fibers.

3 Claims, 3 Drawing Sheets

WOVEN FABRIC OF COMPOSITE MATERIAL

FIELD OF THE INVENTION

The present invention relates to woven fabrics, more particularly to a woven fabric of composite material having glittery colors and better light reflection.

BACKGROUND OF THE INVENTION

Woven fabrics of composite material are used for covering the surface of an object so as to reinforce the structure of the object. The object can be rackets of various types, golf clubs, bicycle parts, materials for making shoes, etc.

Referring to FIG. 3, a woven fabric of composite material of the prior art comprises a transverse thread system 30 and a longitudinal thread system 40, which are woven together in an interlaced fashion. In the texture, one transverse thread is passed around all of the longitudinal threads in a perpendicular direction in a waved way, namely, the transverse thread passing over a longitudinal thread and passing under the next longitudinal thread. An adjacent transverse thread is passed around the longitudinal threads in the same way, but the up locations and the down locations are flipped.

However, the color of the woven fabrics of composite material of the prior art are of single color, which lack visual appeals. To decorate the fabrics, colors are applied on the surfaces of the fabrics by printing and spray painting, which will increase the production cost by using extra labors for the painting job and paints. Further, the paint on a fabric thus made is easy to fall off due to frictional contact with other objects. Even a fabric made of para-Aramid fibers and glass fibers has the above disadvantages.

Motivated by improving the above disadvantages, the inventor invents the present invention for providing an improved woven fabric of composite material.

SUMMARY OF THE INVENTION

Accordingly, the primary objective of the present invention is to provide a woven fabric of composite material having a reinforced structure, bright colors and a light-reflecting effect.

The secondary objective of the present invention is to provide a woven fabric of composite material that is easy to manufacture and suitable for mass production.

To achieve the above objectives, a woven fabric of composite material, according to the present invention comprises a longitudinal thread system, a transverse thread system and a multitude of glittery threads. The transverse thread system is woven together with the longitudinal thread system in an interlaced fashion. The glittery threads are woven into at least one of the longitudinal thread system and the transverse thread system, whereby a woven fabric thus made will have bright colors and a light reflecting effect. Further, the threads of the longitudinal thread system and the transverse thread system are selected from para-Aramid fibers and glass fibers.

The various objects and advantages of the present invention will be more readily understood from the following detailed description when read in conjunction with the appended drawings.

DETAILED DESCRIPTION OF THE PREFERRED EMBODIMENTS

Figure 1:
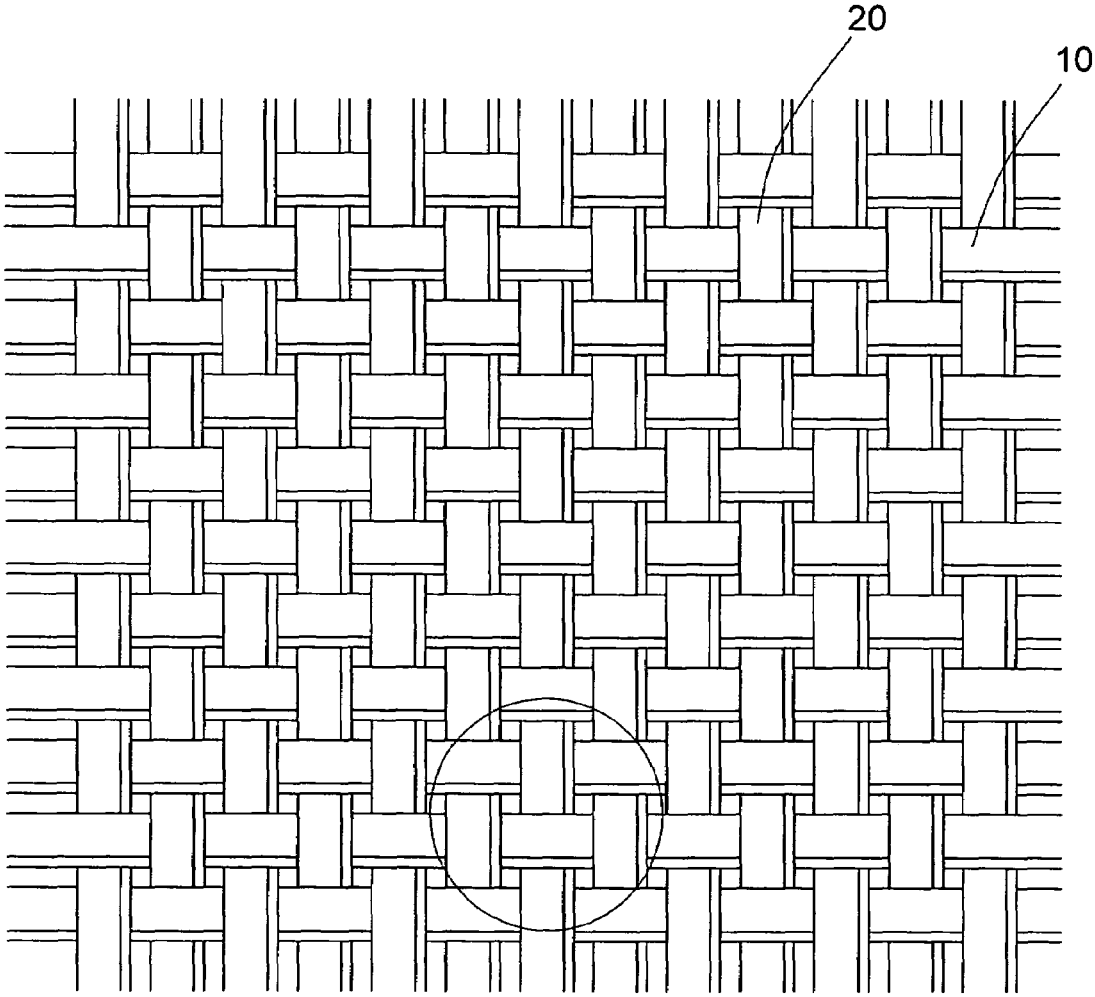
FIG. 1 shows the structure of the present invention as a woven fabric of composite material.
Figure 2:
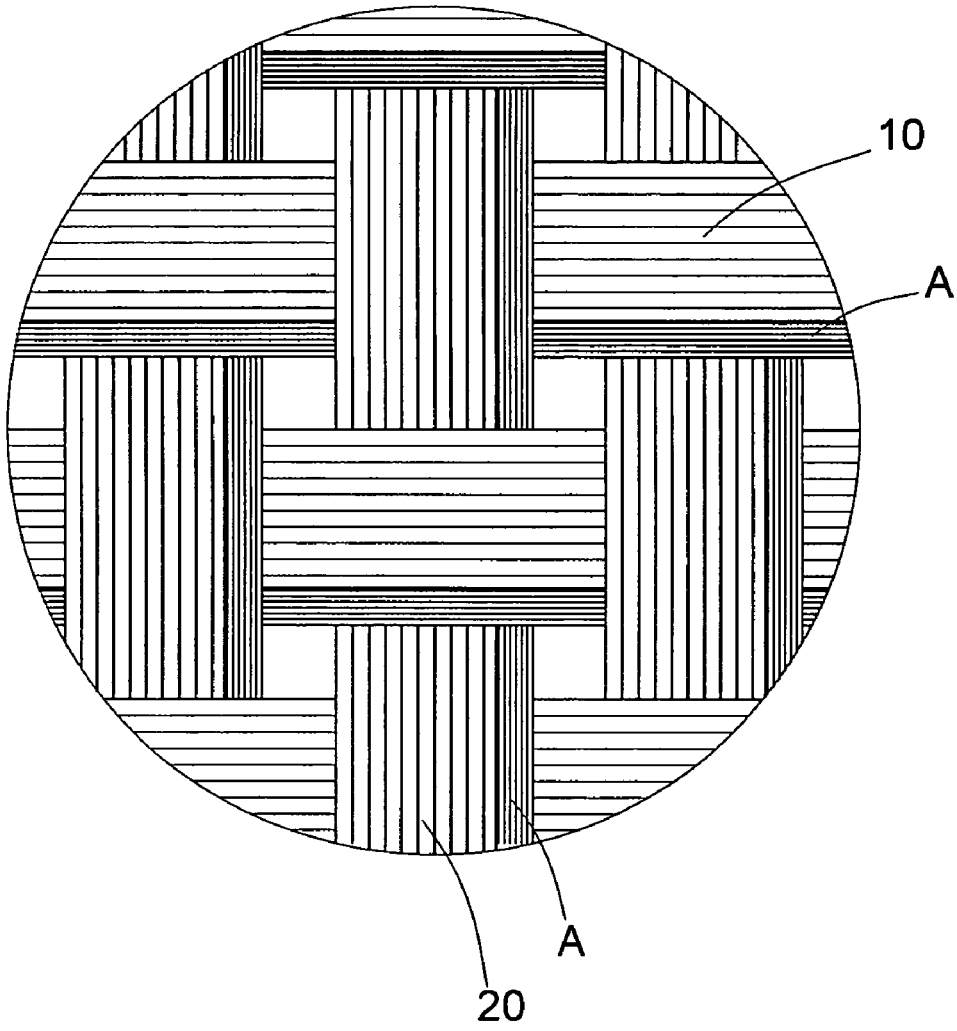
FIG. 2 is a local enlarged view of the woven fabric of composite material in FIG. 1.
Figure 3:
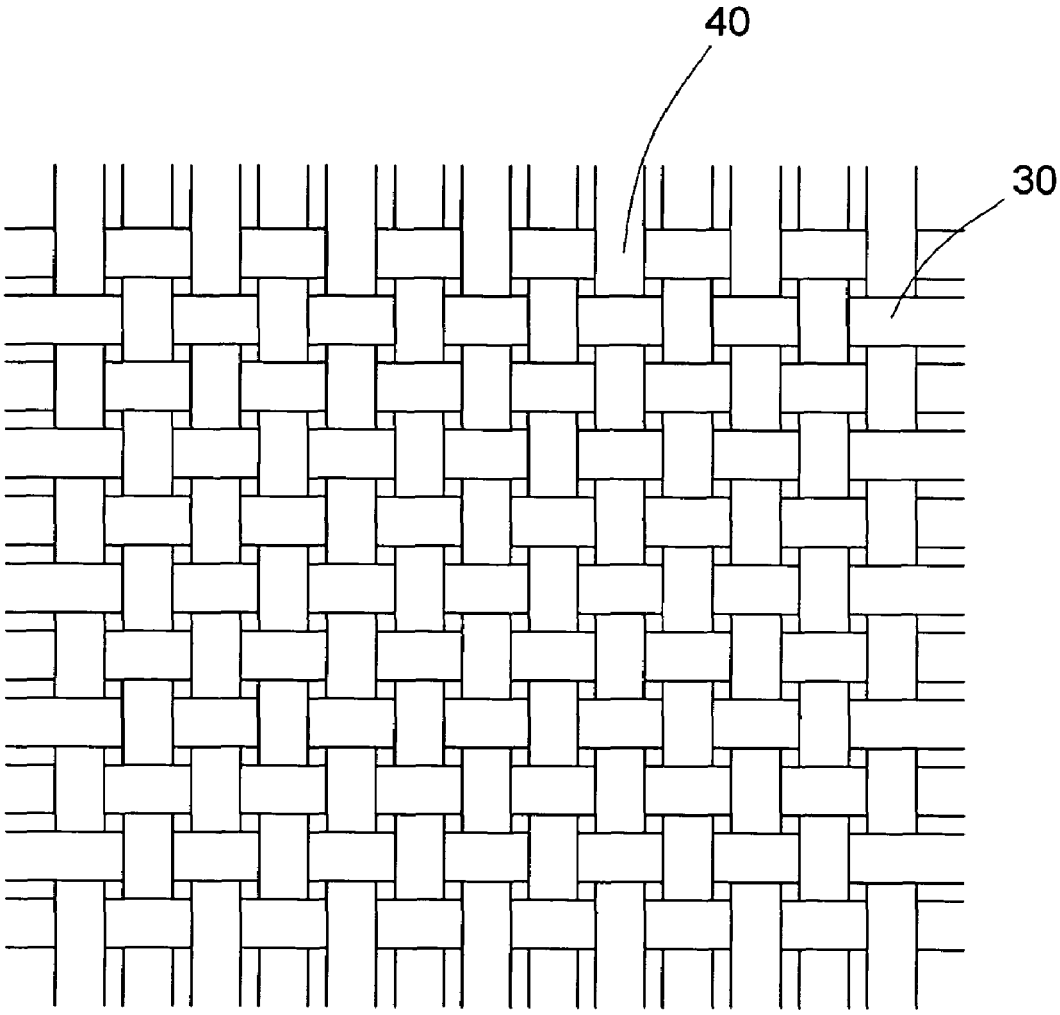
FIG. 3 shows the structure of a woven fabric made of carbon fibers.

Referring to FIGS. 1 and 2, a woven fabric of composite material comprises a transverse thread system 10 and a longitudinal thread system 20. The transverse thread system 10 and the longitudinal thread system 20 are woven together in an interlaced form, as shown in FIG. 1. The transverse thread system 10 and the longitudinal thread system 20 are para-Aramid fibers or glass fibers, at least one of which systems is provided with a multitude of glittery threads A, colored plastic threads or threads having better light reflection, as shown in FIG. 2.

Therefore, as the transverse thread system 10 and the longitudinal thread system 20 are being woven together, glittery threads A are added to either the transverse thread system 10 or the longitudinal thread system 20, so as to reinforce the structure of the fabric and bright up the fabric by providing various light reflecting patterns of visual appeal, as shown in FIG. 2.

Besides the above-mentioned preferred embodiment, the transverse thread system 10 and the longitudinal thread system 20 can be of various combinations so as to provide the same effects.

In a second preferred embodiment, carbon fibers are woven into the transverse thread system 10 and the longitudinal thread system 20 made of para-Aramid fibers or glass fibers.

In a third preferred embodiment, the transverse thread system 10 and the longitudinal thread system 20 are made of carbon fibers or para-Aramid fibers.

In a fourth preferred embodiment, the transverse thread system 10 and the longitudinal thread system 20 are made of carbon fibers or glass fibers.

In a fifth preferred embodiment, the transverse thread system 10 and the longitudinal thread system 20 are made of glass fibers.

In a sixth preferred embodiment, the transverse thread system 10 and the longitudinal thread system 20 are made of para-Aramid fibers.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A woven fabric of composite material, comprising:

a longitudinal thread system;

a transverse thread system, said transverse thread system being woven together with said longitudinal thread system in an interlaced fashion; and a multitude of glittery threads woven into at least one of said longitudinal thread system and said transverse thread system, whereby a woven fabric will have bright colors and a light reflecting effect; and wherein carbon fibers are woven into the transverse thread system and the longitudinal thread system made para-Aramid fibers or glass fibers.

2. A woven fabric of composite material, comprising:

a longitudinal thread system;

a transverse thread system, said transverse thread system being woven together with said longitudinal thread system in an interlaced fashion; and a multitude of glittery threads woven into at least one of said longitudinal thread system and said transverse thread system, whereby a woven fabric will have bright colors and a light reflecting effect; and further comprising a multitude of colored plastic threads that are woven into at least one of said transverse thread system and said longitudinal thread system.

3. A woven fabric of composite material, comprising:

a longitudinal thread system;

a transverse thread system, said transverse thread system being woven together with said longitudinal thread system in an interlaced fashion; and a multitude of glittery threads woven into at least one of said longitudinal thread system and said transverse thread system, whereby a woven fabric will have bright colors and a light reflecting effect; and further comprising a multitude of colorful plastic threads that are woven into at least one of said transverse thread system and said longitudinal thread system.

* * * * *